US009772580B2

(12) United States Patent
Hatanaka

(10) Patent No.: US 9,772,580 B2
(45) Date of Patent: Sep. 26, 2017

(54) DEVELOPMENT DEVICE, IMAGE FORMING UNIT AND IMAGE FORMING APPARATUS

(71) Applicant: Oki Data Corporation, Tokyo (JP)

(72) Inventor: Shun Hatanaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/220,037

(22) Filed: Jul. 26, 2016

(65) Prior Publication Data

US 2017/0031269 A1 Feb. 2, 2017

(30) Foreign Application Priority Data

Jul. 27, 2015 (JP) ..... 2015-147588

(51) Int. Cl.
*G03G 15/08* (2006.01)

(52) U.S. Cl.
CPC ..... *G03G 15/0858* (2013.01)

(58) Field of Classification Search
CPC ..... G03G 15/0831; G03G 15/0856
See application file for complete search history.

(56) References Cited

U.S. PATENT DOCUMENTS 4,668,074 A * 5/1987 Hirozane ..... G03G 15/0858 118/689
2003/0031479 A1* 2/2003 Ito ..... G03G 15/0822 399/27

FOREIGN PATENT DOCUMENTS

JP 63008783 A * 1/1988
JP 2012-053348 A 3/2012

* cited by examiner

*Primary Examiner* — Erika J Villaluna
(74) *Attorney, Agent, or Firm* — Muncy, Geissler, Olds & Lowe, P.C.

(57) ABSTRACT

A development device includes a developer accommodating part that accommodates a developer, a developer detection member that is rotatably supported inside the developer accommodating part and is for detecting an amount of the developer accommodated inside the developer accommodating part, a rotational drive member that rotates the developer detection member around an rotational axis, and a conductive contact member that is formed of a conducive material. Wherein, defining a rotary track through which the developer detection member passes while rotating, a free edge of the contact member is arranged within the rotary track such that the contact member comes in contact with the developer detection member once while the developer detection member makes one rotation, the free edge being distal from where the contact member is fixed.

20 Claims, 13 Drawing Sheets

253
A22
A21
58
52
R52
P1

253
R52
A21
A22
58
52

253
R52
A21
A22
58
52

253
A21
R52
A22
58
52

253
A22
A21
58
P2
52

DEVELOPMENT DEVICE, IMAGE FORMING UNIT AND IMAGE FORMING APPARATUS

CROSS REFERENCE TO RELATED APPLICATION

This application claims priority under 35 USC 119 to Japanese Patent Application No. 2015-147588 filed on Jul. 27, 2015, the entire contents which are incorporated herein by reference.

TECHNICAL FIELD

This invention relates to a development device, an image forming unit, and an image forming apparatus.

BACKGROUND

In general, used in an image forming apparatus such as a printer, a facsimile machine, and a multifunction peripheral (MFP) is a developer amount detection device that detects the amount of a toner as a developer contained in a development device. For example, proposed is a developer amount detection device that detects the amount of a toner inside a development device by using the rotation time (cycle) of a rotating part (stirring bar) of the developer amount detection device that changes according to the amount of the toner inside the development device (for example, see Patent Document 1).

RELATED ART

[Patent Document 1] Unexamined Japanese Patent Application 2012-53348

However, depending on the state of the developer inside the development device, the developer could adhere onto a rotating part of the developer amount detection device, thereby disabling an appropriate detection of the amount of the developer inside the development device. In this case, the amount of the developer inside the development device could not be appropriately maintained, inducing deterioration in print quality.

Then, the objective of this invention is to suppress deterioration in print quality by appropriately maintaining the amount of the developer inside the development device.

SUMMARY

A development device disclosed in the application includes a developer accommodating part that accommodates a developer, a developer detection member that is rotatably supported inside the developer accommodating part and is for detecting an amount of the developer accommodated inside the developer accommodating part, a rotational drive member that rotates the developer detection member around an rotational axis, and a conductive contact member that is formed of a conducive material. Wherein, defining a rotary track through which the developer detection member passes while rotating, a free edge of the contact member is arranged within the rotary track such that the contact member comes in contact with the developer detection member once while the developer detection member makes one rotation, the free edge being distal from where the contact member is fixed.

An image forming unit disclosed in the application includes the development device discussed above, and an image carrier to which the developer is supplied from the development device.

An image forming apparatus disclosed in the application is provided with the image forming unit discussed above.

According to this invention, deterioration in print quality can be suppressed by appropriately maintaining the amount of the developer inside the development device.

BRIEF DESCRIPTIONS OF THE DRAWINGS

DETAILED DESCRIPTIONS OF EMBODIMENTS

<<Embodiment 1>>

Figure 1:
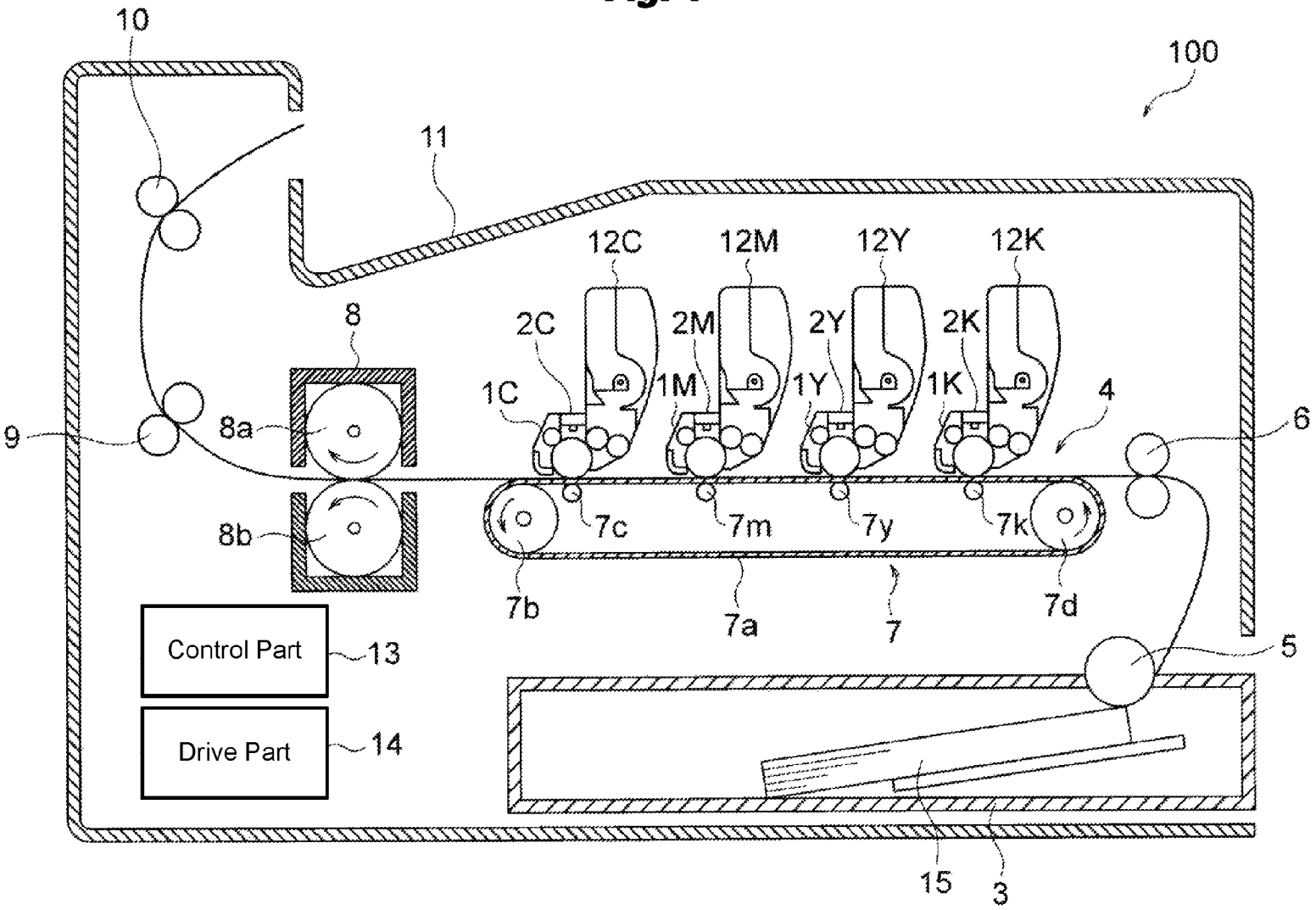
FIG. 1 is a longitudinal cross-sectional view showing the structure of an image forming apparatus of Embodiment 1 of this invention.

<Structure of image forming apparatus 100> FIG. 1 is a longitudinal cross-sectional view showing the structure of an image forming apparatus 100 of Embodiment 1 of this invention.

The image forming apparatus 100 comprises image forming units 1K, 1Y, 1M, and 1C that form images on a medium 15 such as a sheet of paper. The image forming apparatus 100 can perform color printing by an electrophotographic system using toners as developers in black color (K), yellow color (Y), magenta color (M), and cyan color (C). Specifically, the image forming units 1K, 1Y, 1M, and 1C form images on the medium 15 using black color, yellow color, magenta color, and cyan color.

Also, the image forming apparatus 100 comprises exposure heads 2K, 2Y, 2M, and 2C as exposure parts, a tray 3, a medium carrying path 4, a sheet feeding roller 5, a carrying roller 6, a transfer belt unit 7, a fuser 8, ejection rollers 9 and 10, a stacker cover 11, toner cartridges 12K, 12Y, 12M, and 12C as developer cartridges, a control part 13, and a drive part 14. The image forming units 1K, 1Y, 1M, and 1C, the sheet feeding roller 5, the carrying roller 6, the transfer belt unit 7, the fuser 8, and the ejection rollers 9 and 10 are disposed along the medium carrying path 4.

The exposure heads 2K, 2Y, 2M, and 2C are provided so as to oppose the image forming units 1K, 1Y, 1M, and 1C, respectively. The exposure heads 2K, 2Y, 2M, and 2C form electrostatic latent images based on image data by irradiating image carriers inside the image forming units 1K, 1Y, 1M, and 1C with light (for example, laser light), respectively.

The tray 3 accommodates the medium 15. The medium 15 is carried by the sheet feeding roller 5 and the carrying roller 6 toward the image forming units 1K, 1Y, 1M, and 1C.

The medium carrying path 4 is a carrying path where the medium 15 is carried.

The sheet feeding roller 5 is provided in a connecting part between the tray 3 and the medium carrying path 4 and forwards the medium 15 from the tray 3.

The carrying roller 6 is provided on the medium carrying path 4 and carries the medium 15 forwarded by the sheet feeding roller 5.

The transfer belt unit 7 comprises a transfer belt 7*a* that is an endless belt, a drive roller 7*b*, a driven roller 7*d*, and transfer rollers 7*k*, 7*y*, 7*m*, and 7*c*. The transfer belt 7*a* forms part of the medium carrying path 4 and carries the medium 15. The drive roller 7*b* rotates by a drive force from the drive part 14 and has the transfer belt 7*a* rotate. The driven roller 7*d* is rotatable and movably supports the transfer belt 7*a*. The transfer rollers 7*k*, 7*y*, 7*m*, and 7*c* transfer images formed in the image forming units 1K, 1Y, 1M, and 1C to the medium 15, respectively.

The fuser 8 comprises a heat application roller 8*a* and a pressure application roller 8*b*. The fuser 8 has images transferred onto the medium 15 fused to the medium 15 using the heat application roller 8*a* and the pressure application roller 8*b*.

The ejection rollers 9 and 10 carry the medium 15 and eject the medium 15 to the outside of the image forming apparatus 100.

The stacker cover 11 holds the medium 15 ejected by the ejection rollers 9 and 10.

The toner cartridges 12K, 12Y, 12M, and 12C are detachably provided to the image forming apparatus 100 and stores toners to replenish the image forming units 1K, 1Y, 1M, and 1C, respectively. Also, stored in the toner cartridges 12K, 12Y, 12M, and 12C are toners used by the image forming units 1K, 1Y, 1M, and 1C, respectively. For example, stored in the toner cartridges 12K, 12Y, 12M, and 12C are toners in black color, yellow color, magenta color, and cyan color, respectively.

The control part 13 controls individual components inside the image forming apparatus 100. The drive part 14 comprises a drive force generation part such as a motor, and a drive force transmission mechanism (such as a gear) that transmits the drive force to the individual components inside the image forming apparatus 100.

Next, explained are the structures of the image forming units 1K, 1Y, 1M, and 1C, and the structures of the toner cartridges 12K, 12Y, 12M, and 12C. Note that because the image forming units 1K, 1Y, 1M, and 1C have the same structure with one another, the structure of the image forming unit 1K is explained as the representative structure of the image forming units 1K, 1Y, 1M, and 1C. Also, because the toner cartridges 12K, 12Y, 12M, and 12C have the same structure with one another, the structure of the toner cartridge 12K is explained as the representative structure of the toner cartridges 12K, 12Y, 12M, and 12C.

Figure 2:
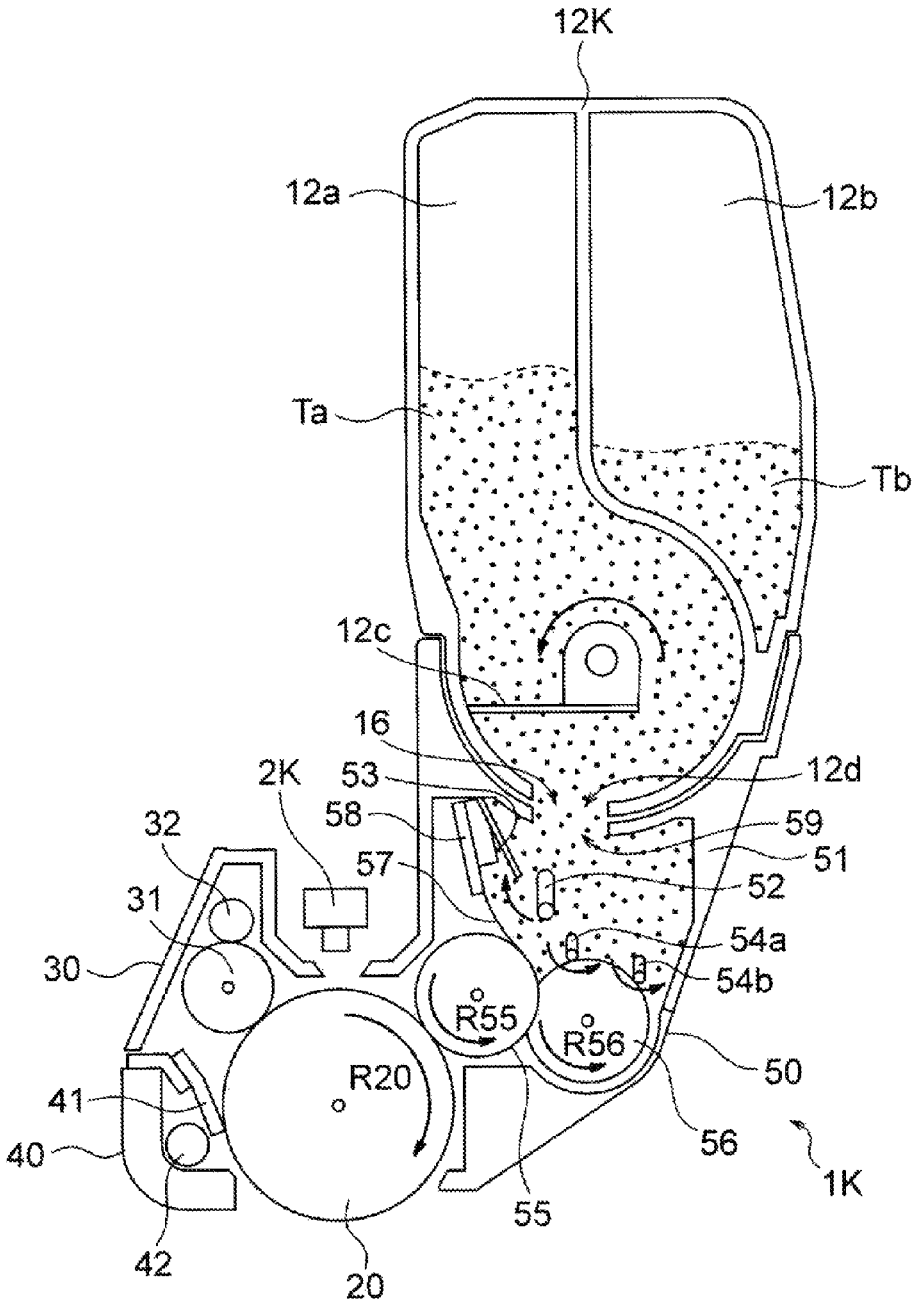
FIG. 2 is a cross-sectional view showing the internal structures of an image forming unit and a toner cartridge.
Figure 3A:
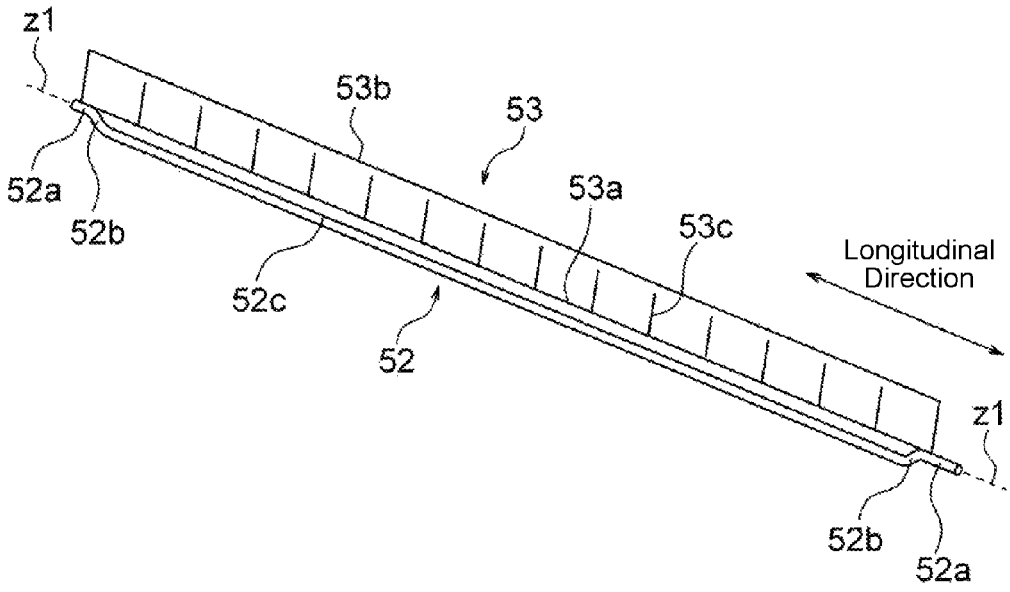
FIGS. 3A and 3B are perspective views showing the structures of a contact member and a toner amount detection member.
Figure 3B:
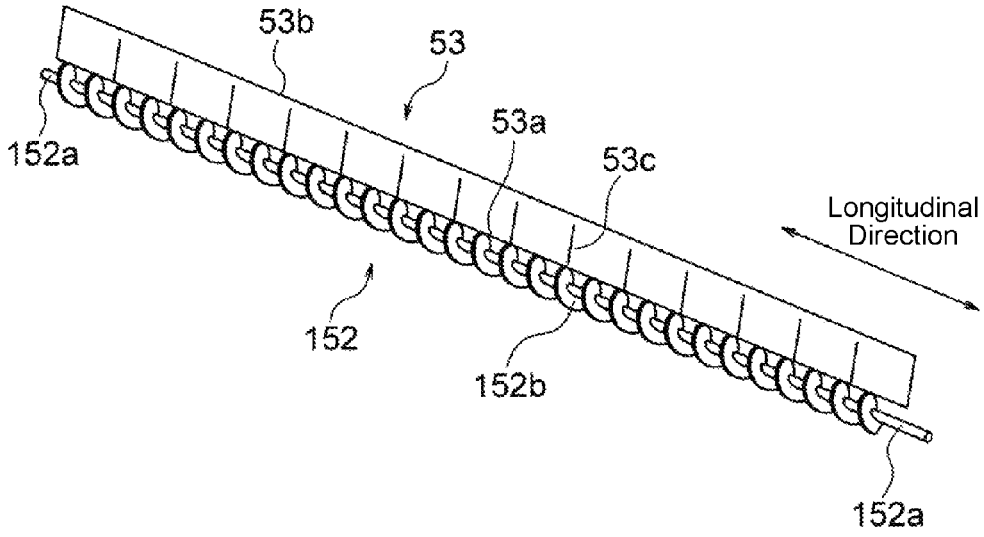

FIG. 2 is a cross-sectional view showing the internal structures of the image forming unit 1K and the toner cartridge 12K. FIG. 3A is a perspective view showing the structures of a contact member 53 and a toner amount detection member 52. FIG. 3B is a perspective view showing the structures of the contact member 53 and a toner amount detection member 152 as a modification.

The toner cartridge 12K comprises a replenishing toner receiving region 12*a*, a waste toner receiving region 12*b*, a stirring member 12*c*, and an opening 12*d* (first opening). Stored in the replenishing toner receiving region 12*a* is a toner Ta (replenishing toner) for replenishing the image forming unit 1K. Stored in the waste toner receiving region 12*b* is a used waste toner Tb. The stirring member 12*c* is rotatably supported within the replenishing toner receiving region 12*a* and stirs the stored toner Ta by rotating. The opening 12*d* forms a toner supply port 16 for replenishing the image forming unit 1K with the toner Ta.

The image forming unit 1K comprises a photosensitive drum 20 as an image carrier, a charging device 30 that charges the surface of the photosensitive drum 20, a development device 50 that supplies the toner Ta to the surface of the photosensitive drum 20, and a cleaning device 40 that cleans the surface of the photosensitive drum 20.

The photosensitive drum 20 rotates in the direction of an arrow R20 by receiving a drive force from the drive part 14.

The charging device 30 comprises a charging roller 31 and a cleaning roller 32. The charging roller 31 is controlled by the control part 13, and a charging bias is applied to it. The charging device 30 charges the surface of the photosensitive drum 20 by having the charging roller 31 to which the charging bias is applied contact with the surface of the photosensitive drum 20. The cleaning roller 32 cleans the surface of the charging roller 31 by rotating in contact with the surface of the charging roller 31.

The cleaning device 40 comprises a cleaning blade 41 and a waste toner carrying member 42. The cleaning device 40 cleans the surface of the photosensitive drum 20 by having the tip of the cleaning blade 41 contact with the surface of the photosensitive drum 20. The waste toner carrying member 42 is disposed below the cleaning blade 41 and carries the waste toner Tb scraped off the surface of the photosensitive drum 20 toward the waste toner receiving region 12*b*.

The development device 50 comprises a toner accommodating part 51 as a developer accommodating part that accommodates the toner Ta, the toner amount detection member 52 (rotational body) as a developer detection member, a rotational drive member 70 (rotational member) that rotates the toner amount detection member 52, and the contact member 53 that contacts with the toner amount detection member 52.

Also, the development device 50 comprises stirring members 54*a* and 54*b* that stir the toner Ta accommodated in the toner accommodating part 51, a development roller 55 (also called "toner carrier") as a developer carrier, a toner supply roller 56 that supplies the toner Ta to the development roller 55, a development blade 57 for thinning the toner Ta supplied to the development roller 55, a supporting member 58 that supports the contact member 53 and the development blade 57, and an opening 59 (second opening). The development roller 55 rotates in the direction of an arrow R55. The toner supply roller 56 rotates in the direction of an arrow R56.

The opening 59 forms the toner supply port 16 for replenishment of the toner Ta from the toner cartridge 12K. The image forming unit 1K (specifically, the development device 50) and the toner cartridge 12K are connected via the toner supply port 16.

The toner amount detection member 52 is used for detecting the amount of the toner Ta accommodated inside the toner accommodating part 51. The toner amount detection member 52 is rotatably supported inside the toner accommodating part 51.

As shown in FIG. 3A, the toner amount detection member 52 is rotatably supported and has a crank shape protruding in a rotational radial direction. In other words, the toner amount detection member 52 comprises first parts 52*a* that are provided on both end sides and include a rotation axis z1, second parts 52*b* that are connected to the first parts 52*a* and extend in a direction away from the rotation axis z1, and a third part 52*c* that connects the second parts provided on both end sides. Because the toner amount detection member 52 has its center of gravity set in a position away from the rotation axis, a moment of inertia is generated by rotation.

As shown in FIG. 3B, the toner amount detection member 152 as a modification may have a spiral shape. Specifically, in the example shown in FIG. 3B, the toner amount detection member 152 comprises a rotation shaft 152*a* and a blade 152*b* provided in a spiral shape on the outer circumference of the rotation shaft 152*a*. For example, by setting the structure of the blade 152*b* so that its center of gravity is shifted from the rotation shaft 152*a*, the toner amount detection member 152 can realize a rotation operation by its self-weight fall.

The contact member 53 is configured of a film having conductivity (conductive film) and electrically grounded via the supporting member 58 or the like for example. The contact member 53 should desirably have flexibility. Specifically, the contact member 53 should desirably be a plastic film containing carbon (for example, carbon black). In this embodiment, used as the contact member 53 is a plastic film of 0.125 mm in thickness and 80 mΩ in area resistance value (surface resistance). However, although a plastic film of 80 mΩ in area resistance value is used as the contact member 53 in this embodiment, the area resistance value of the contact member 53 only needs to be 80 mΩ or lower.

As shown in FIGS. 3A and 3B, the contact member 53 comprises a fixed edge 53*b* fixed inside the toner accommodating part 51, a free edge 53*a* provided on the opposite side of the fixed edge 53*b*, and multiple incisions 53*c* formed in a direction away from the free edge 53*a*. In this embodiment, the contact member 53 has the incisions 53*c* so as to make 15 divisions in the longitudinal direction of the toner amount detection member 52. However, a contact member having no incisions 53*c* formed may be used as the contact member 53. Also, in this embodiment, the fixed edge 53*b* is fixed to the supporting member 58.

The development roller 55 is disposed so as to contact with the surface of the photosensitive drum 20. The development roller 55 is controlled by the control part 13, and a development bias is applied to it. The development device 50 supplies a toner to the surface of the photosensitive drum 20 by having the development roller 55, to which the development bias is applied, contact with the surface of the photosensitive drum 20. The development blade 57 is disposed so as to contact with the surface of the development roller 55.

Figure 4A:
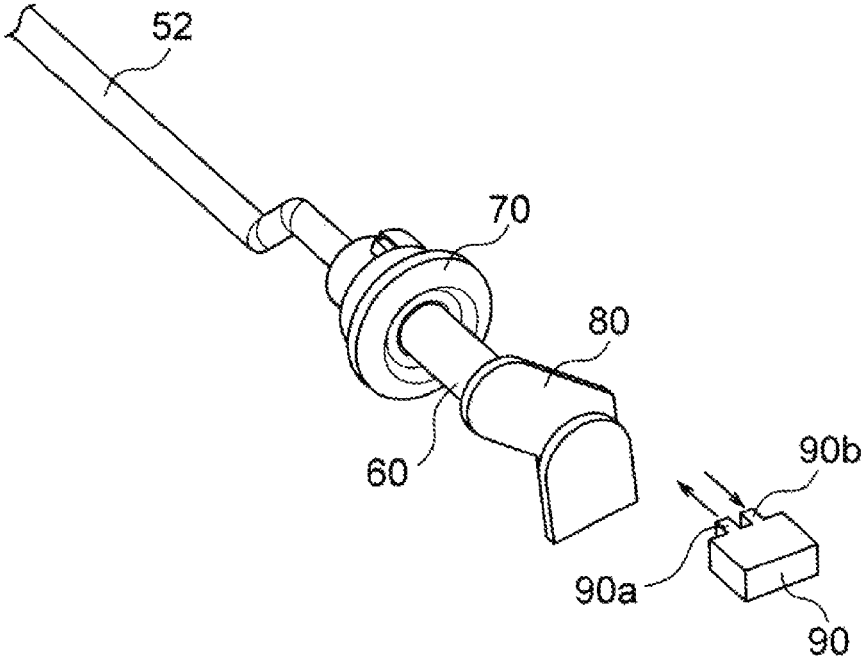
FIG. 4A is a perspective view showing the structures of one end side of the toner amount detection member and its surroundings.
Figure 4B:
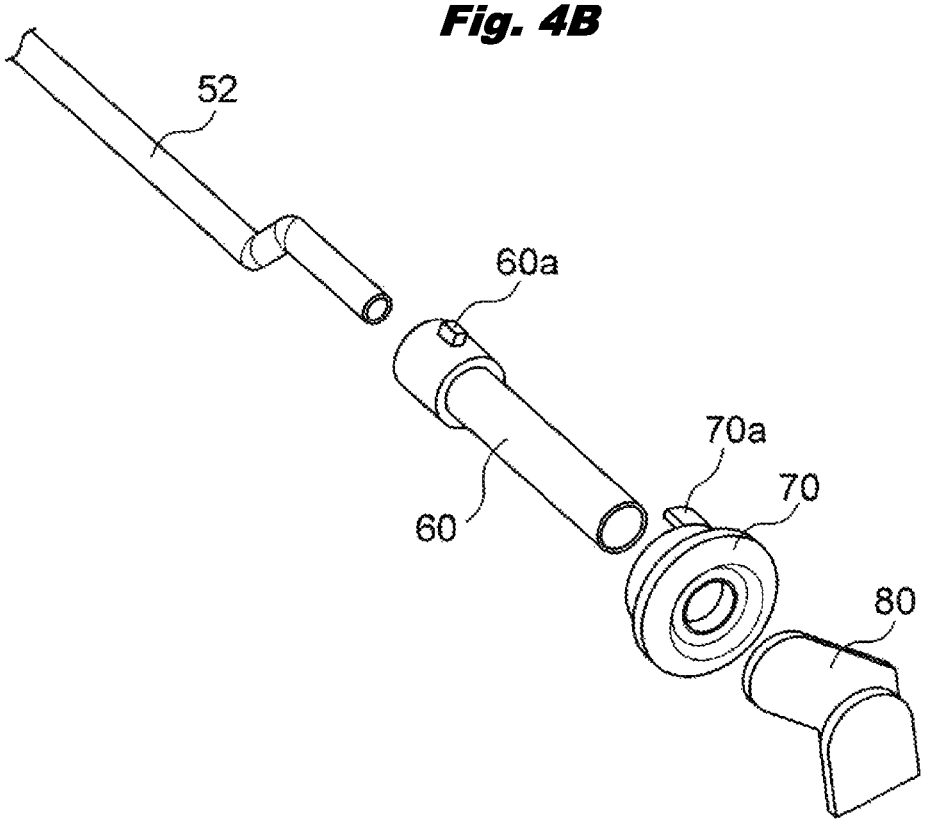
FIG. 4B is an exploded perspective view of the structures of the one end side of the toner amount detection member and its surroundings.

Next, the structures of the toner amount detection member 52 and its surroundings are explained. FIG. 4A is a perspective view showing the structures of one end side of the toner amount detection member 52 and its surroundings. FIG. 4B is an exploded perspective view of the structures of the one end side of the toner amount detection member 52 and its surroundings The toner amount detection member 52 is connected to the supporting member 60. The toner amount detection member 52 is rotatably supported in one unit with the supporting member 60 inside the toner accommodating part 51. The supporting member 60 comprises a protrusion 60*a* (first protrusion).

The rotational drive member 70 as a drive source of the toner amount detection member 52 is fitted around the supporting member 60. The toner amount detection member 52 rotates in correspondence with a rotation of the rotational drive member 70. The rotational drive member 70 comprises a protrusion 70*a* (second protrusion) that engages with the protrusion 60*a* of the supporting member 60. The protrusion 70*a* is formed in a semi-cylindrical shape. The protrusion 70*a* rotates around the rotation center 60X of the supporting member 60 with a constant speed.

The reflective plate 80 is connected to the tip part of the supporting member 60. In a position opposing the reflective plate 80, a sensor 90 is provided. The sensor 90 is provided on the inner wall of the chassis of the image forming apparatus 100 for example. However, the sensor 90 may be provided on the inner wall of the toner accommodating part 51. The sensor 90 comprises a light emitting part 90*a* and a light receiving part 90*b*. The sensor 90 emits light from the light emitting part 90*a* and detects the position of the toner amount detection member 52. Specifically, the position of the toner amount detection member 52 is detected by light emitted from the light emitting part 90*a* reaching the reflective plate 80, and the light receiving part 90*b* receiving light reflected by the reflective plate 80 (reflected light).

<Operations of the image forming apparatus 100> Upon receiving a print command from a host such as a computer, the control part 13 issues print operation commands to individual components. The medium 15 is separated into single pieces by the sheet feeding roller 5 and carried to the image forming units 1K, 1Y, 1M, and 1C by the carrying roller 6. When color printing is executed, toner images are formed on image carries of the individual image forming units 1K, 1Y, 1M, and 1C, and the toner images are transferred onto the medium 15 by the transfer rollers 7*k*, 7*y*, 7*m*, and 7*c*. The medium 15, to which the toner images are transferred, has the toner images fused by the fuser 8. The medium 15 having the toner images fused is ejected by the ejection rollers 9 and 10 to the stacker cover 11.

Next, explained is a development process in the individual image forming units. However, because the image forming units 1K, 1Y, 1M, and 1C have the same basic operations with one another, the operations of the image forming unit 1K are explained as the representative operation example of the image forming units 1K, 1Y, 1M, and 1C.

Figure 5:
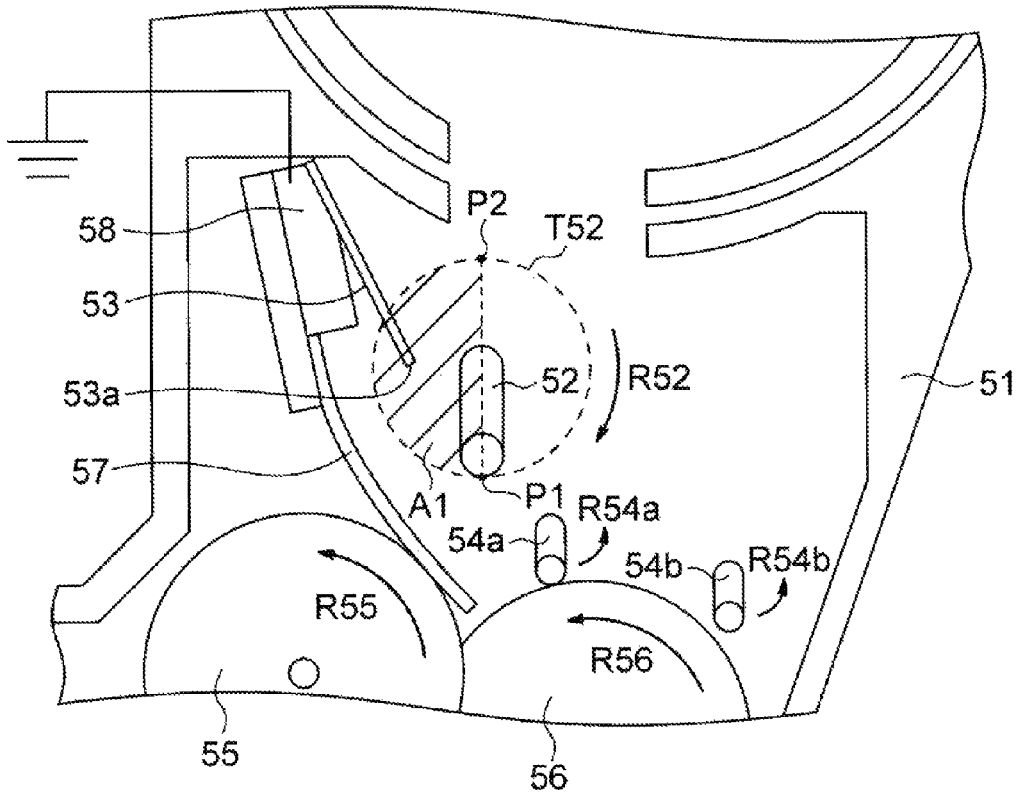
FIG. 5 is an enlarged cross-sectional view showing the structure of a development device.

FIG. 5 is an enlarged cross-sectional view showing the structure of the development device 50. A track T52 (rotary track) indicates a track through which the toner amount detection member 52 passes.

Upon receiving a print command from a host device such as a computer, the control part 13 has the toner supply roller 56 rotated by the drive part 14. As shown in FIG. 5, the toner supply roller 56 rotates in the direction of the arrow R56 and supplies the toner Ta to the development roller 55. The stirring members 54*a* and 54*b* stir the toner Ta by rotating in the directions of the arrows R54*a* and R54*b*, respectively. Because the development blade 57 is in contact with the development roller 55, once the development roller 55 rotates in the direction of the arrow R55, the toner Ta on the development roller 55 is formed in a thin layer shape by the development blade 57, and the toner Ta on the development roller 55 is charged.

The surface of the photosensitive drum 20 is charged by the charging roller 31. The exposure head 2K irradiates the surface of the charged photosensitive drum 20 with light (for example, laser light) based on image data to form an electrostatic latent image on the photosensitive drum 20. By the toner Ta being supplied from the development roller 55 onto the photosensitive drum 20 where the electrostatic latent image is formed, a toner image is formed on the photosensitive drum 20. The toner image formed on the photosensitive drum 20 is transferred to the medium 15 by the transfer roller 7*k*.

The toner Ta remaining on the photosensitive drum 20 without being transferred to the medium 15 is scraped off by the cleaning blade 41. The toner Ta scraped off by the cleaning blade 41 is carried by the waste toner carrying member 42 and stored in the waste toner receiving region 12*b*.

By rotating, the stirring member 12*c* inside the replenishing toner receiving region 12*a* stirs the toner Ta inside the replenishing toner receiving region 12*a* and supplies the toner Ta into the toner accommodating part 51.

Figure 6A:
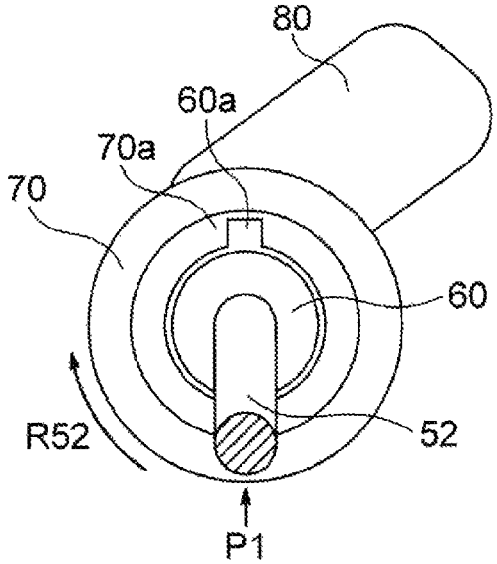
FIGS. 6A-6C are cross-sectional views showing the operations of a rotational drive member and the toner amount detection member in the order of time sequence.
Figure 6B:
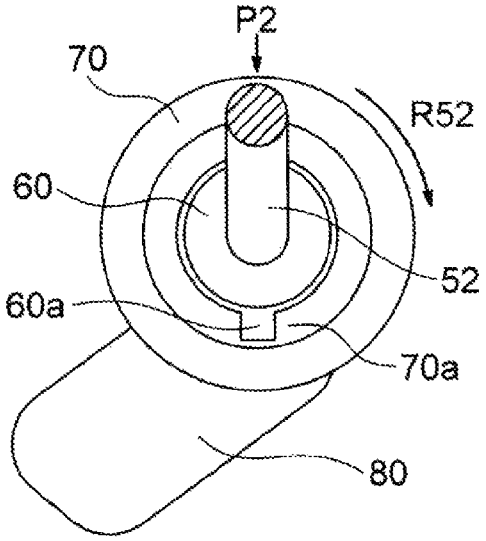
Figure 6C:
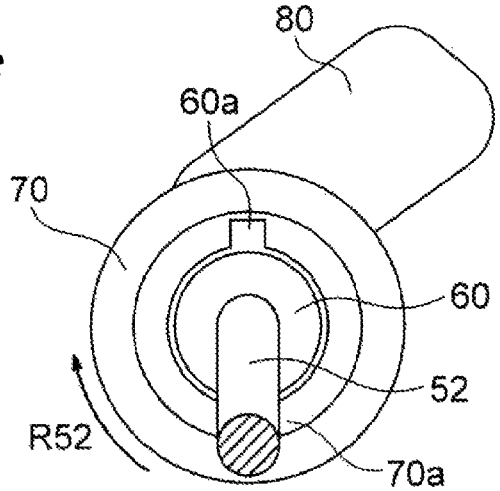

Next, explained is a toner amount detection process. FIGS. 6A-6C are cross-sectional views showing the operations of the rotational drive member 70 and the toner amount detection member 52 in the order of time sequence. Note that FIGS. 6A-6C are cross-sectional views where the rotational drive member 70 and the toner amount detection member 52 are seen in the longitudinal direction of the toner amount detection member 52.

The toner amount detection member 52 rotates in the direction of an arrow R52 so as to go through the track T52 by receiving a drive force from the drive part 14.

In this embodiment, the tip part of the contact member 53 (specifically, the free edge 53*a* or distal edge) is positioned inside a shaded region A1 in FIG. 5. When rotating through the track T52, the toner amount detection member 52 contacts with the contact member 53. Specifically, when the toner amount detection member 52 rotates from the lowest point P1 to the highest point P2, the toner amount detection member 52 contacts with the contact member 53. In this case, the toner amount detection member 52 should desirably contact with the contact member 53 within the region A1.

FIG. 6A shows a state when the rotational drive of the toner amount detection member 52 is started by the rotational drive member 70. As shown in FIG. 6A, the toner amount detection member 52 and the supporting member 60 are fixed to each other, and the protrusion 60*a* of the supporting member 60 and the protrusion 70*a* of the rotational drive member 70 are engaged. Therefore, by the rotational drive member 70 rotating, the toner amount detection member 52 is pressed up while rotating from the lowest point P1 to the highest point P2. The moving speed of the member 52 is the same as the rotating speed of the rotational drive member 70.

FIG. 6B shows a state when the toner amount detection member 52 has reached the highest point P2 by the toner amount detection member 52 being rotated by the rotational drive member 70. Once the toner amount detection member 52 reaches the highest point P2, because the rotation speed of the toner amount detection member 52 by its self-weight fall is faster than the rotation speed of the rotational drive member 70, the toner amount detection member 52 falls by its self weight while rotating from the highest point P2 toward the lowest point P1 (self-weight fall).

FIG. 6C shows a state when the toner amount detection member 52 has rotated from the highest point P2 to the lowest point P1 (self-weight fall). Note that although shown in FIG. 6C is a state where the toner Ta does is not present around the toner amount detection member 52 as an example, if the toner Ta is accommodated around the toner amount detection member 52, the toner amount detection member 52 that started a rotation by its self-weight fall contacts with the toner Ta accommodated inside the toner accommodating part 51 and stops its self-weight fall before reaching the lowest point P1. Once the toner Ta inside the toner accommodating part 51 decreases, the toner amount detection member 52 rotates accompanying the decrease of the toner Ta inside the toner accommodating part 51 (that is, rotates by its self-weight fall) and reaches the lowest point P1 in due course. Once the toner amount detection member 52 falls by its self weight from the highest point P2, accompanying the rotation of the toner amount detection member 52, the protrusion 60*a* of the supporting member 60 separates from the protrusion 70*a* of the rotational drive member 70.

The rotational drive member 70 continues to rotate receiving a drive force from the drive part 14 even after the toner amount detection member 52 reached the lowest point P1 from the highest point P2 (fell by its self weight). By the rotational drive member 70 continuing to rotate, once the protrusion 70*a* of the rotational drive member 70 and the protrusion 60*a* of the supporting member 60 engage again, as shown in FIG. 6A, the toner amount detection member 52 is pressed up while rotating from the lowest point P1 to the highest point P2 again.

As shown in FIGS. 6A-6C, the reflective plate 80 rotates together with the toner amount detection member 52. In other words, accompanying the rotation of the toner amount detection member 52, the reflective plate 80 rotates in the same direction as the rotation direction of the toner amount detection member 52 (direction of the arrow R52). Because the position of the reflective plate 80 in the track and the position of the toner amount detection member 52 in the track correspond to each other, the control part 13 can obtain the position of the toner amount detection member 52 by having the position of the reflective plate 80 detected by the sensor 90.

Figure 7A:
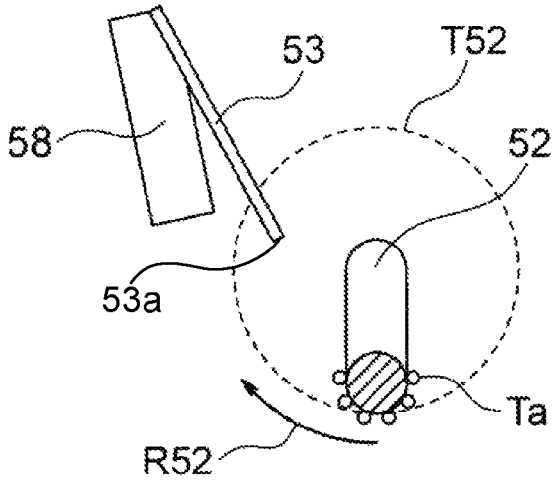
FIGS. 7A-7C are cross-sectional views showing the operations of the contact member and the toner amount detection member in the order of time sequence.
Figure 7B:
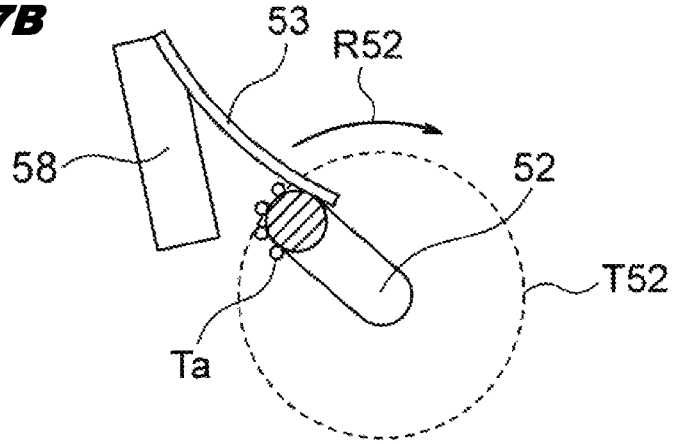
Figure 7C:
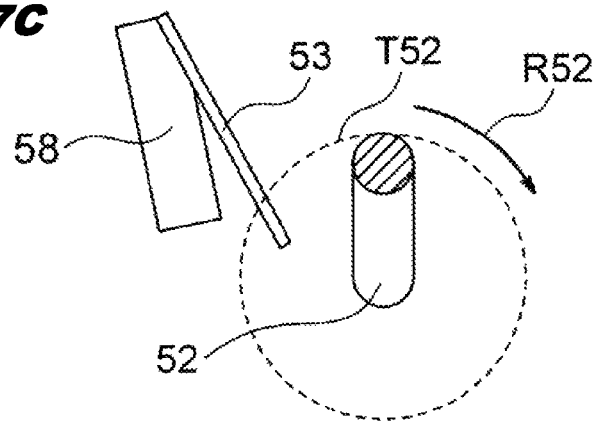

FIGS. 7A-7C are cross-sectional views showing the operations of the contact member 53 and the toner amount detection member 52 in the order of time sequence. Note that FIGS. 7A-7C are cross-sectional views when the contact member 53 and the toner amount detection member 52 are seen in the longitudinal direction of the toner amount detection member 52.

FIG. 7A shows a state where the toner Ta adheres to the toner amount detection member 52. The toner Ta inside the toner accommodating part 51 may degrade due to changes in temperature or humidity, mutual pressure among the toner Ta, and the like. By the toner Ta inside the toner accommodating part 51 degrading, the toner Ta may agglomerates, and flowability of the toner Ta inside the toner accommodating part 51 may deteriorate. Also, by the stirring members 54*a*, 54*b*, and the like stirring the toner Ta inside the toner accommodating part 51, it becomes easier for the toner Ta to be charged. If the toner Ta inside the toner accommodating part 51 agglomerates, it becomes easier for the agglomerated toner Ta to adhere physically to the toner amount detection member 52. Also, if the toner Ta inside the toner accommodating part 51 is charged, it becomes easier for the charged toner Ta to adhere electrically to the toner amount detection member 52 (electrostatic agglomeration). As shown in FIG. 7A, if the toner Ta adheres to the toner amount detection member 52, resistance the toner amount detection member 52 receives during its rotation increases, which may affect the rotation operation of the toner amount detection member 52. Also, by the toner Ta adhering to the toner amount detection member 52, the stop position at the time of self-weight fall may become higher than the proper position to stop by the volume of the adhering toner Ta, which may prevent toner amount detection and toner replenishment from being executed normally.

As shown in FIG. 7B, if the toner amount detection member 52 rotates from the lowest point P1 toward the highest point P2, the contact member 53 contacts with the toner amount detection member 52. Because the contact member 53 has flexibility, while in contact with the toner amount detection member 52, the contact member 53 physically scrapes off the toner Ta adhering to the toner amount detection member 52 while warping due to a force received from the toner amount detection member 52. That is, the toner amount detection member 52 is physically cleaned by contacting with the contact member 53.

As shown in FIGS. 7B and 7C, the contact member 53 warps due to a force received from the toner amount detection member 52, and when the toner amount detection member 52 leaves the contact member 53, the contact member 53 energetically returns from the warped state to the original position (stationary position). By the operation of the contact member 53 energetically returning to the original position, the contact member 53 can strongly scrape off the toner Ta adhering to the toner amount detection member 52. The toner amount detection member 52 should desirably separate from the contact member 53 before reaching the highest point P2.

Also, even if the toner Ta is compressed inside the toner accommodating part 51, by the operation of the contact member 53 energetically returning from the warped state to the original position, the toner Ta inside the toner accommodating part 51 is stirred. That is, because the contact member 53 has a function to stir the toner Ta in the track T52 of the toner amount detection member 52, occurrences of voids in the track T52 (that is, a state where the toner Ta is not present in the track T52) can be prevented. By preventing the occurrences of voids in the track T52, the rotation operation of the toner amount detection member 52 can be appropriately maintained, preventing misdetections by the sensor 90. In this invention, the free edge 53*a* of the contact member 53 is arranged within the track T52 from the side view.

Also, because the contact member 53 is conductive and electrically grounded, once the toner amount detection member 52 contacts with the contact member 53, the toner amount detection member 52 is electrically grounded via the contact member 53. Even if the toner amount detection member 52 is charged, because the toner amount detection member 52 is neutralized when the toner amount detection member 52 contacts with the contact member 53, electrical adhesion of the toner Ta to the toner amount detection member 52 can be suppressed.

Figure 8A:
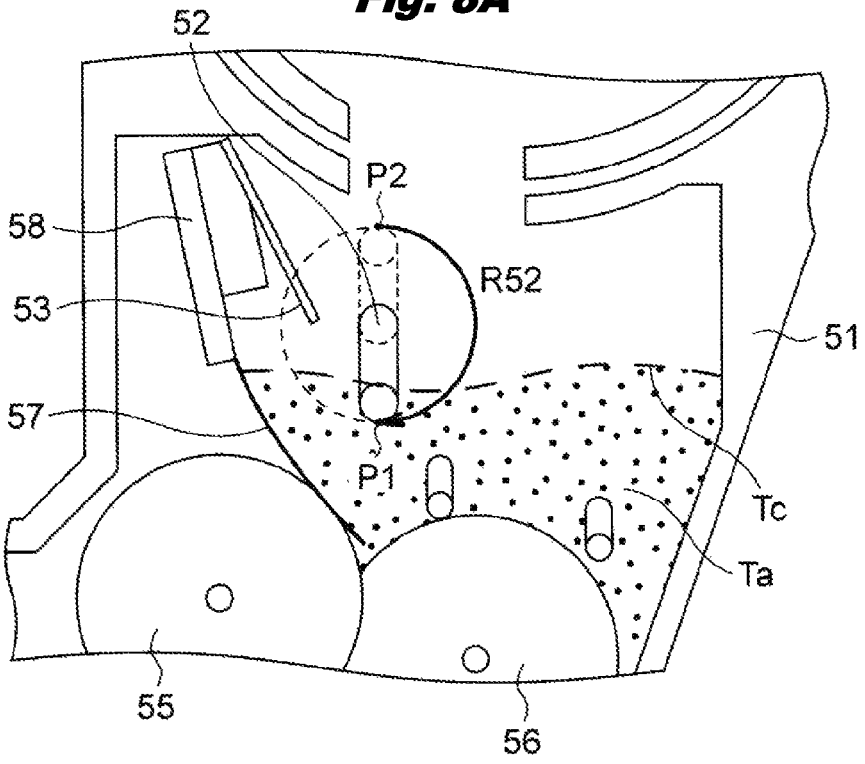
FIGS. 8A and 8B are cross-sectional views of the development device showing the operations of the toner amount detection member.
Figure 8B:
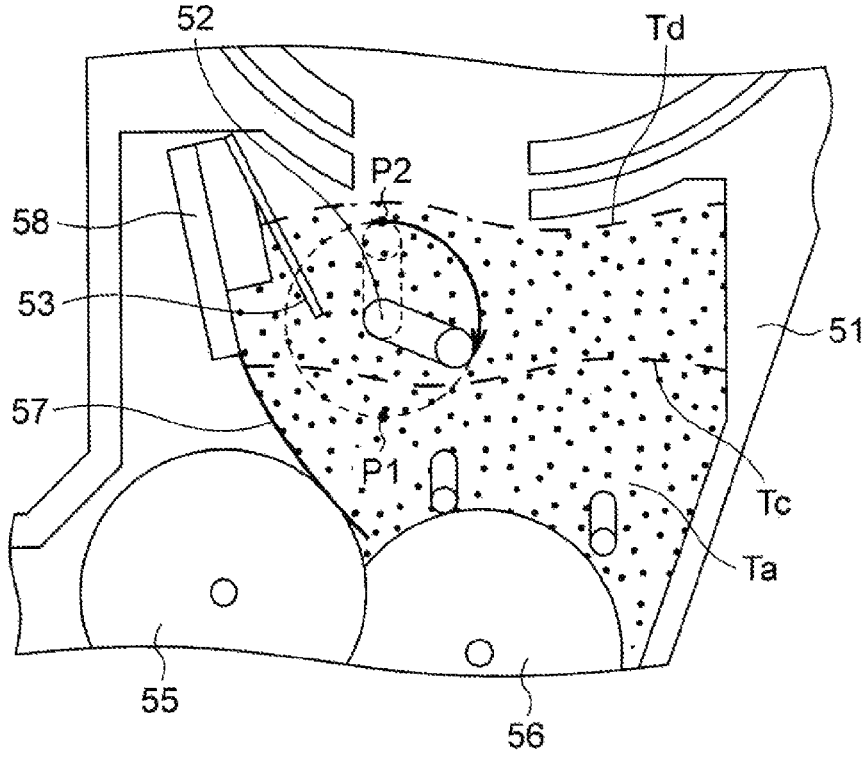

FIGS. 8A and 8B are cross-sectional views of the development device 50 showing the operations of the toner amount detection member 52. FIG. 8A shows a state (called "toner-low") where the amount of the toner Ta inside the toner accommodating part 51 is small. FIG. 8B shows a state (called "toner-full") where the amount of the toner Ta inside the toner accommodating part 51 is sufficient.

As shown in FIG. 8A, in the toner-low state, because the position of the upper face Tc (upper face of the toner layer in the toner-low state) of the toner Ta (toner layer) accommodated in the toner accommodating part 51 has dropped, resistance the toner amount detection member 52 receives from the toner Ta (that is, toner layer) is small. Therefore, the toner amount detection member 52 rotates, by its self-weight fall, faster than the rotation of the protrusion 70*a* and reaches the lowest point P1 or the vicinity of the lowest point P1.

On the other hand, as shown in FIG. 8B, in the toner-full state, because the position of the upper face Td (upper face of the toner layer in the toner-full state) of the toner Ta (toner layer) accommodated in the toner accommodating part 51 is higher than the position of the highest point P2, resistance the toner amount detection member 52 receives from the toner Ta (toner layer) is large. Therefore, the toner amount detection member 52 does not fall by its self weight to the lowest point P1 or the vicinity of the lowest point P1.

When the toner amount detection member 52 is positioned at the lowest point P1, the reflective plate 80 opposes the sensor 90 (specifically, the light emitting part 90*a* and the light receiving part 90*b*). When the reflective plate 80 and the sensor 90 oppose each other, once the sensor 90 emits light from the light emitting part 90*a*, light from the sensor 90 is reflected by the reflective plate 80. Light reflected by the reflective plate 80 (reflected light) is received by the light receiving part 90*b* of the sensor 90, and the position of the toner amount detection member 52 is detected.

Figure 9:
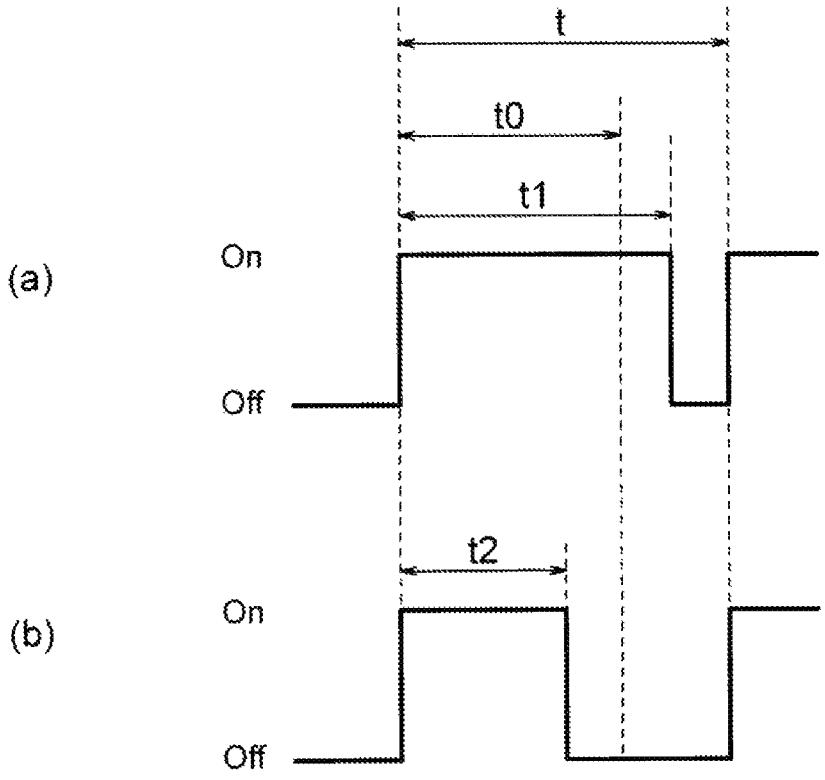
FIG. 9 illustrates timing charts (a) to (b) showing light detection operations by a sensor.

(a) and (b) of FIG. 9 are timing charts showing light detection operations by the sensor 90. (a) of FIG. 9 shows a light detection operation by the sensor 90 during time t while the toner amount detection member 52 makes one rotation (one cycle) in the toner-low state. (b) of FIG. 9 shows a light detection operation by the sensor 90 during time t while the toner amount detection member 52 makes one rotation (one cycle) in the toner-full state. Once the sensor 90 receives reflected light from the reflective plate 80, a detection signal ("On" in (a) and (b) of FIG. 9) is sent to the control part 13. While the sensor 90 does not receive reflected light from the reflective plate 80, the detection signal is not sent to the control part 13 ("Off" in (a) and (b) of FIG. 9).

As shown in (a) of FIG. 9, the sensor 90 detects the dwell time of the toner amount detection member 52 at the lowest point P1 (time the sensor 90 is receiving reflected light), and if the dwell time t1 is longer than preset set time t0, detects the toner-low. In other words, if the dwell time t1 is longer than the preset set time t0, the control part 13 judges the state as the toner-low.

As show in (b) of FIG. 9, the sensor 90 detects the dwell time of the toner amount detection member 52 at the lowest point P1 (time the sensor 90 is receiving reflected light), and if the dwell time t2 is shorter than the set time t0, it detects the toner-full. In other words, if the dwell time t2 is shorter than the preset set time t0, the control part 13 judges the state as the toner-full.

As explained above, according to Embodiment 1, by the toner amount detection member 52 contacting with the conductive contact member 53, physical or electrical agglomeration of the toner Ta to the toner amount detection member 52 can be suppressed, and toner amount detection accuracy using the toner amount detection member 52 can be appropriately maintained. By the amount of the toner Ta inside the development device 50 being maintained appropriately, deterioration in print quality by the image forming apparatus 100 can be suppressed.

Because the contact member 53 has flexibility, it warps when contacting with the toner amount detection member 52, and when the contact member 53 returns from the warped state to the original position, the contact member 53 can strongly scrape off the toner Ta adhering to the toner amount detection member 52.

By separating from the contact member 53 before reaching the highest point P2 after starting a rotation from the lowest point P1, the toner amount detection member 52 never has its self-weight fall operation from the highest point P2 obstructed by the contact member 53.

<<Embodiment 2>>

An image forming apparatus in Embodiment 2 is provided with a contact member 253 that is different from the contact member 53 provided in the image forming apparatus 100 of Embodiment 1. That is, the structure and operations of the image forming apparatus in Embodiment 2 are the same as the structure and operations of the image forming apparatus 100 in Embodiment 1 except that their contact members are different from each other. Therefore, the components of the image forming apparatus in Embodiment 2 that are identical or correspond to the components of the image forming apparatus 100 in Embodiment 1 are given the same codes as the components of the image forming apparatus 100 in Embodiment 1, in their explanations.

Figure 10:
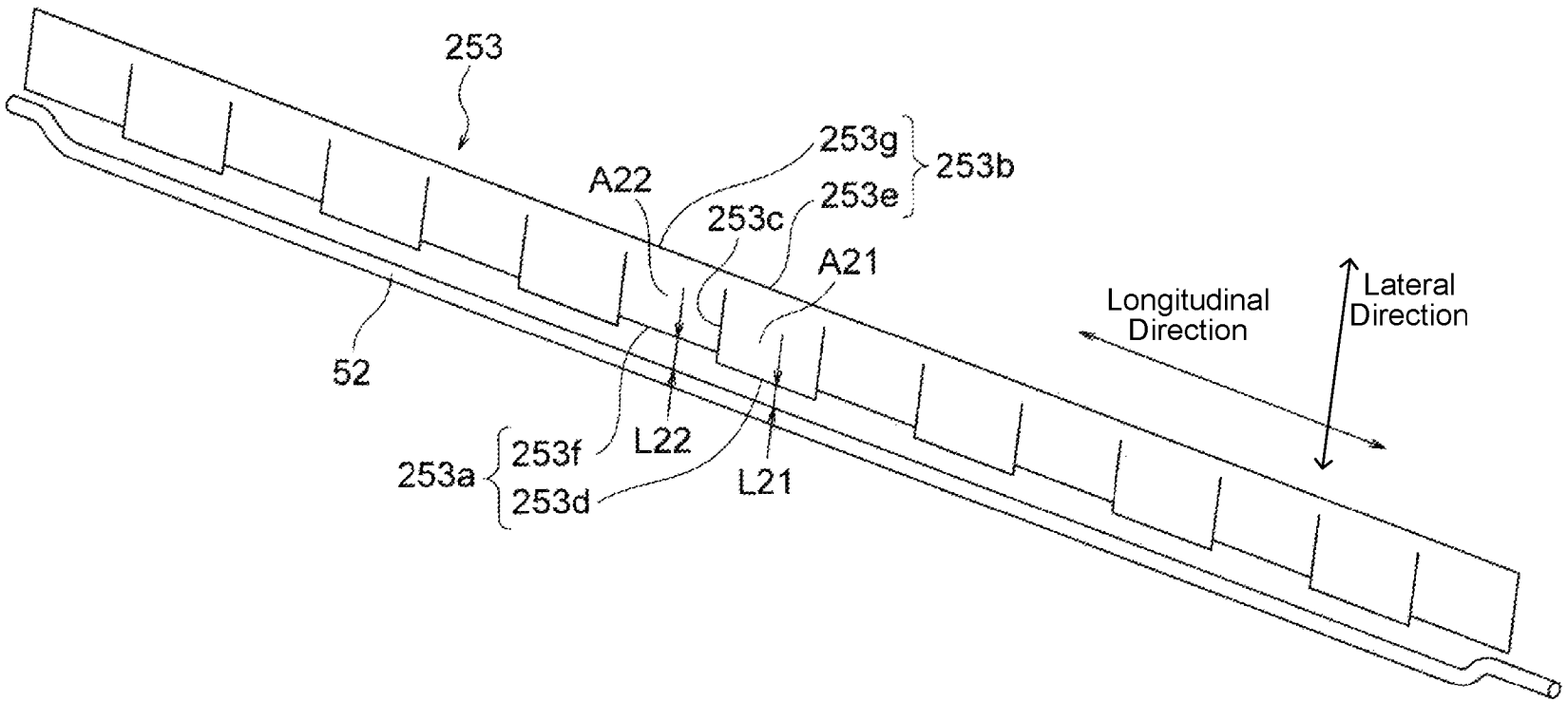
FIG. 10 is a perspective view showing the structures of a contact member and a toner amount detection member in Embodiment 2.

FIG. 10 is a perspective view showing the structures of the contact member 253 and a toner amount detection member 52 in Embodiment 2. The contact member 253 comprises a fixed edge 253*b* fixed inside a toner accommodating part 51, a free edge 253*a* provided on the opposite side of the fixed edge 253*b*, and multiple incisions 253*c* formed in a direction away from the free edge 253*a* (or toward the fixed edge 253*b*). In this embodiment, the contact member 253 has the incisions 253*c* so as to make 15 divisions in the longitudinal direction of the toner amount detection member 52.

The contact member 253 comprises regions A21 (first regions) and regions A22 (second regions) formed by the multiple incisions 253*c*. The regions A21 and the regions A22 should desirably disposed alternately in the longitudinal direction of the contact member 253. The regions A21 comprise free edges 253*d* and fixed edges 253*e*. The regions A22 comprise free edges 253*f* and fixed edges 253*g*. The free edge 253*a* of the contact member 253 includes the free edges 253*d* in the regions A21 and the free edges 253*f* in the regions A22. The fixed edge 253*b* of the contact member 253 includes the fixed edges 253*e* in the regions A21 and the fixed edges 253*g* in the regions A22.

The distances between the free edge 253*a* and the fixed edge 253*b* of the contact member 253 in the regions A21 and the regions A22 are different from each other. Specifically, in a separated state where the toner amount detection member 52 is separated from the contact member 253, the distance L21 between the free edges 253*d* and the toner amount detection member 52 in the regions A21 is shorter than the distance L22 between the free edges 253*f* and the toner amount detection member 52 in the regions A22.

FIGS. 11A-11E are cross-sectional views showing, in the order of time sequence, changes in the state of the contact member 253 when the toner amount detection member 52 rotates from the lowest point P1 to the highest point P2. Note that FIGS. 11A-11E are cross-sectional views where the contact member 253 is seen in the longitudinal direction of the contact member 253.

Figures 11A, 11B, 11C, 11D, 11E:
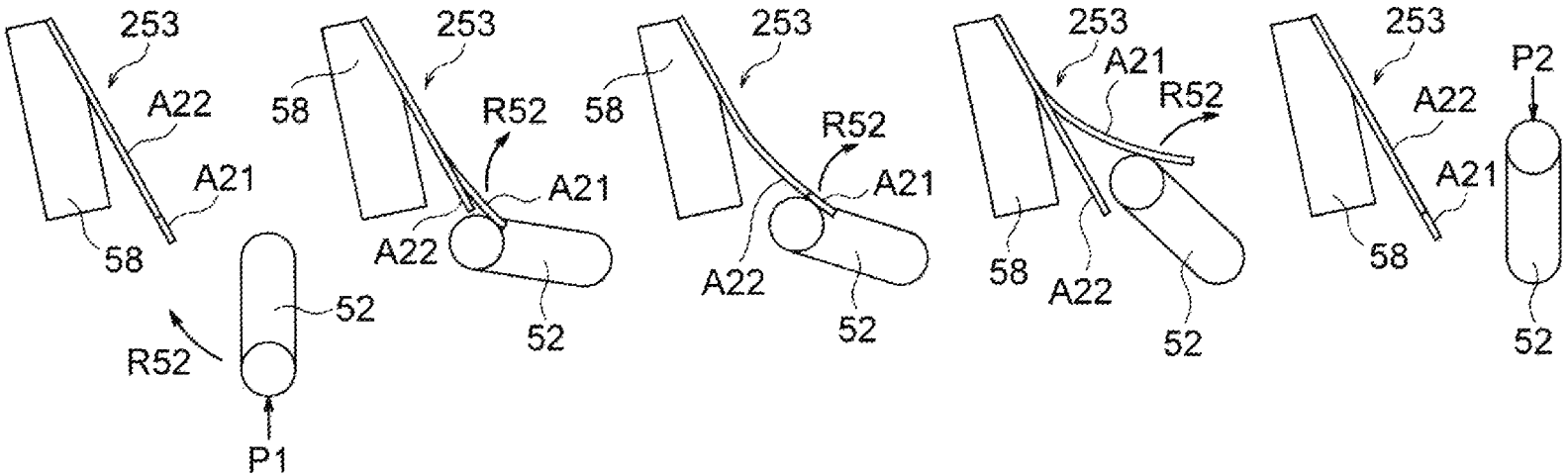
FIGS. 11A-11E are cross-sectional views showing changes in the state of the contact member when the toner amount detection member rotates from the lowest point to the highest point in the order of time sequence.

As shown in FIGS. 11A and 11B, when the toner amount detection member 52 rotates from the lowest point P1 toward the highest point P2, the toner amount detection member 52 contacts with the regions A21 before the regions A22 of the contact member 253.

As shown in FIG. 11C, after contacting with the regions A21 of the contact member 253, the toner amount detection member 52 rotates in contact with the regions A21, and contacts with the regions A22. If the toner amount detection member 52 continues to rotate in contact with the regions A21 and A22 of the contact member 253 in the direction of an arrow R52, the regions A21 and A22 of the contact member 253 warp in the rotation direction of the toner amount detection member 52.

As shown in FIG. 11D, if the toner amount detection member 52 continues to rotate, in due course, the regions A22 of the contact member 253 separate from the toner amount detection member 52 before the regions A21 do, and the regions A22 of the contact member 253 return to the original positions (stationary positions) while scraping off a toner Ta adhering to the toner amount detection member 52. Also, the regions A22 of the contact member 253 return to the original positions while stirring the toner Ta inside the toner accommodating part 51 (for example, the toner Ta around the track of the toner amount detection member 52) in returning to the original positions.

As shown in FIG. 11E, if the toner amount detection member 52 continues to rotate in contact with the regions A21 of the contact member 253, in due course, the regions A21 of the contact member 253 separate from the toner amount detection member 52, and the regions A21 of the contact member 253 return to the original positions (stationary positions) while scraping off the toner Ta adhering to the toner amount detection member 52. Also, the regions A21 of the contact member 253 return to the original positions while stirring the toner Ta inside the toner accommodating part 51 (for example, the toner Ta around the track of the toner amount detection member 52) in returning to the original positions. After the regions A21 of the contact member 253 separate from the toner amount detection member 52, the toner amount detection member 52 reaches the highest point P2.

As explained above, according to Embodiment 2, because the contact member 253 comprises multiple regions having different distances to the toner amount detection member 52, while the toner amount detection member 52 makes one rotation, the contact member 253 can perform multiple stirring operations when part of the regions of the contact member 253 separate from the toner amount detection member 52.

Because the stirring operations of the contact member 253 can give vibrations to the toner Ta inside the toner accommodating part 51 (for example, the toner Ta around the track of the toner amount detection member 52), agglomeration of the toner Ta inside the toner accommodating part 51 (including agglomeration of the toner Ta to the toner amount detection member 52) can be prevented.

Figure 11F:
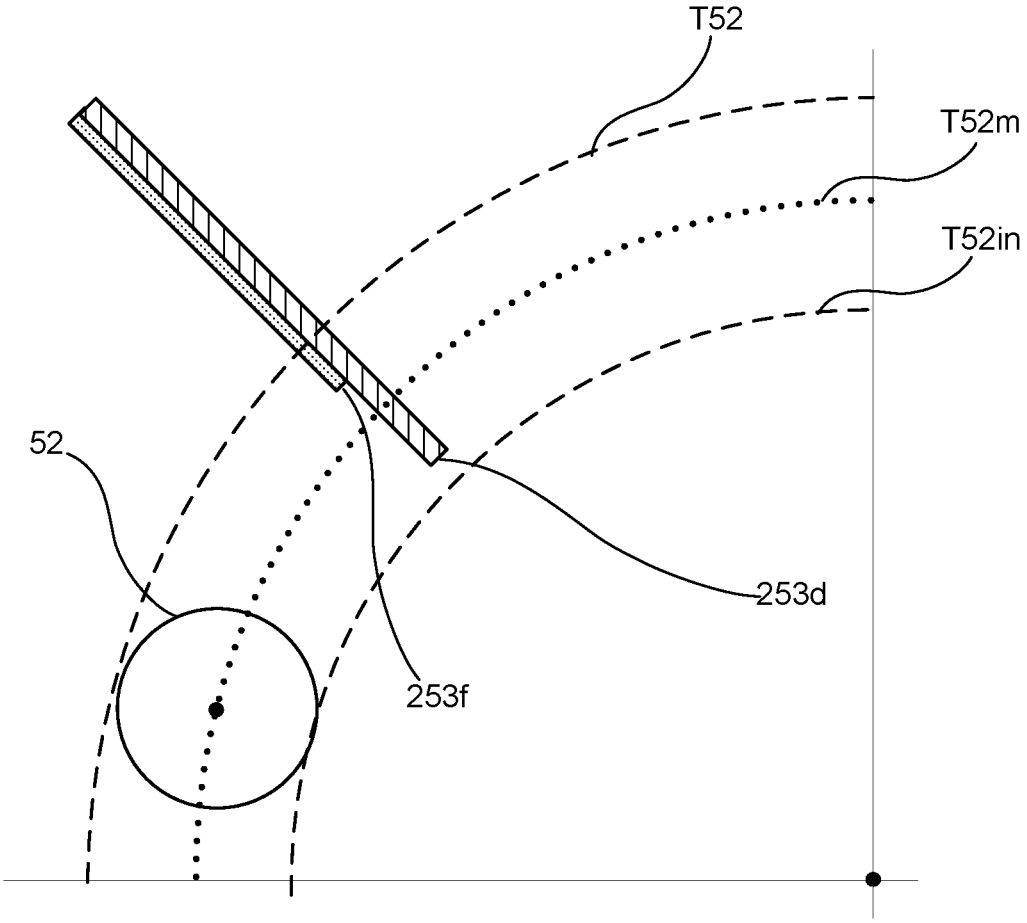
FIG. 11F shows track paths of the detection member.

By preventing agglomeration of the toner Ta inside the toner accommodating part 51 (including agglomeration of the toner Ta to the toner amount detection member 52), toner amount detection accuracy using the toner amount detection member 52 can be appropriately maintained. By the amount of the toner Ta inside the development device 50 being maintained appropriately, deterioration in print quality by the image forming apparatus can be suppressed. FIG. 11F illustrates rotary tracks T52, T52*m* and T52 in drawn by the toner amount detection member 52.

<<Embodiment 3>>

An image forming apparatus in Embodiment 3 is provided with a different contact member 353 that is different from the contact member 53 provided in the image forming apparatus 100 of Embodiment 1. That is, the structure and operations of the image forming apparatus in Embodiment 3 are the same as the structure and operations of the image forming apparatus 100 in Embodiment 1 except that their contact members are different from each other. Therefore, the components of the image forming apparatus in Embodiment 3 that are identical or correspond to the components of the image forming apparatus 100 in Embodiment 1 are given the same codes as the components of the image forming apparatus 100 in Embodiment 1 in their explanations.

Figure 12:
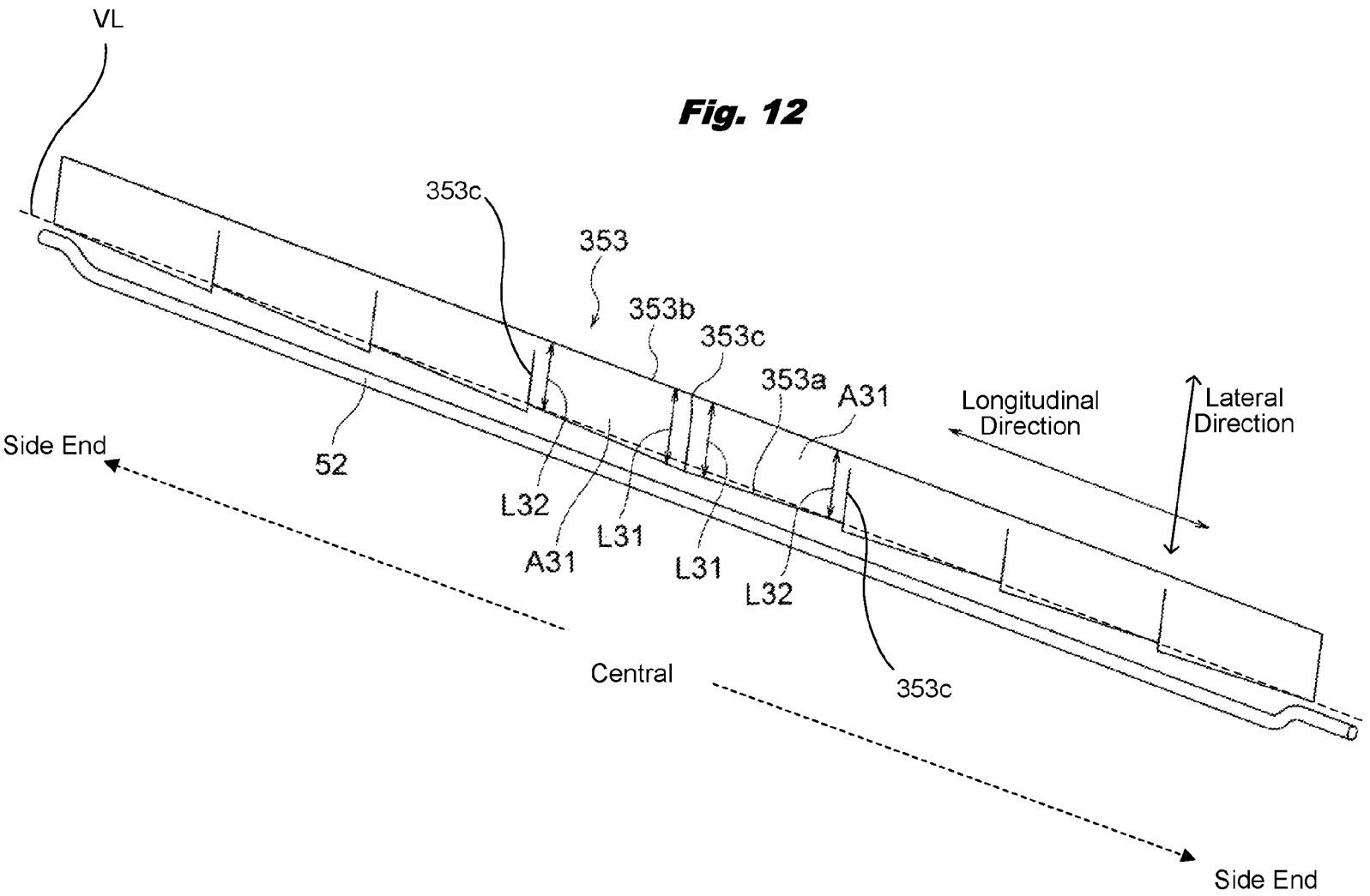
FIG. 12 is a perspective view showing the structures of a contact member and a toner amount detection member in Embodiment 3.

FIG. 12 is a perspective view showing the structures of a contact member 353 and a toner amount detection member 52 in Embodiment 3. The contact member 353 comprises a fixed edge 353*b* fixed inside a toner accommodating part 51, a free edge 353*a* provided on the opposite side of the fixed edge 353*b*, and multiple incisions 353*c* formed in a direction away from the free edge 353*a* (or toward the fixed edge 353*b*). In this embodiment, the contact member 353 has the incisions 353*c* so as to make 4 divisions from the center to both end sides in the longitudinal direction of the toner amount detection member 52.

The contact member 353 comprises multiple contact regions A31 formed by the multiple incisions 353*c*. In each of the multiple contact regions A31, the free edge 353*a* is inclined relative to a virtual line VL along the longitudinal direction of the contact member 353. Specifically, the contact member 353 is configured so that in each of the multiple contact regions A31, the distance from the fixed edge 353*b* to the free edge 353*a* becomes shorter toward one end side (or one of two side ends) from the central (or central side) in the longitudinal direction of the contact member 353. In other words, in each of the contact regions A31, the distance L31 from the fixed edge 353*b* to the free edge 353*a* in the central side of the longitudinal direction of the contact member 353 is longer than the distance L32 from the fixed edge 353*b* to the free edge 353*a* in the one end side of the longitudinal direction of the contact member 353. In FIG. 12, the central side and two of the end sides are shown.

When the toner amount detection member 52 contacts with the contact member 353, the toner amount detection member 52 contacts with the contact regions A31 of the contact member 353 sequentially from the central side in the longitudinal direction of the contact member 353. Thereby, the contact regions A31 of the contact member 353 warp sequentially from the central side in the longitudinal direction of the contact member 353 and return to the original positions (stationary positions) sequentially from the central side. By such operations of the contact member 353, the contact member 353 realizes a stirring function for the longitudinal direction of the contact member 353. Thereby, a toner Ta around the contact member 353 (including the toner Ta adhering to the toner amount detection member 52) can be moved (stirred) in the longitudinal direction of the contact member 353.

As explained above, according to Embodiment 3, while the toner amount detection member 52 makes one rotation, the contact member 353 can also execute a stirring function when each of the contact regions A31 of the contact member 353 separates from the toner amount detection member 52 in the longitudinal direction of the contact member 353 in addition to a direction perpendicular to the longitudinal direction of the contact member 353.

Because the contact member 353 realizes the stirring function of the toner Ta in the track of the toner amount detection member 52 in the longitudinal direction and a direction perpendicular to the longitudinal direction of the contact member 353, occurrences of voids in the track of the toner amount detection member 52 (that is, a state where the toner Ta is absent in the track of the toner amount detection member 52) can be prevented. By preventing the occurrences of voids in the track of the toner amount detection member 52, the rotation operation of the toner amount detection member 52 can be appropriately maintained, and misdetections by a sensor 90 can be prevented.

By the amount of the toner Ta inside the development device 50 being maintained appropriately, deterioration in print quality by the image forming apparatus can be suppressed.

The development device 50 explained in the above embodiments can be applied to various kinds of image forming apparatuses using an electrophotographic system (such as copiers, light emitting diode printers, laser beam printers, facsimile machines, and multifunction machines).

What is claimed is:

1. A development device, comprising:

a developer accommodating part that accommodates a developer, a developer detection member that is rotatably supported inside the developer accommodating part and is for detecting an amount of the developer accommodated inside the developer accommodating part, a rotational drive member that rotates the developer detection member around a rotational axis, and a conductive contact member that is formed of a conductive material, wherein defining a rotary track through which the developer detection member passes while rotating, a free edge of the contact member is arranged within the rotary track such that the contact member comes in contact with the developer detection member while the developer detection member makes one rotation, the free edge being opposite from where the contact member is fixed, the developer detection member rotates about the rotational axis through a lowest point and a highest point of rotary track, while the developer detection member travels from the lowest point to the highest point, the developer detection member is driven by the rotational drive member, contacts the conductive contact member and separates from the conductive contact member before the developer detection member reaches the highest point of the rotary track, when the developer detection member travels from the highest point to the lowest point, the developer detection member falls towards the lowest point by its self-weight, and the rotation of the developer detection member is stopped by a surface of the developer.

2. The development device according to claim 1, wherein the developer detection member comprises:

first parts that are provided on both end sides and include the rotation axis, second parts that are connected to the first parts and extend in a direction away from the rotation axis, and a third part that connects the second parts provided on the both end sides.

3. The development device according to claim 1, wherein the conductive contact member is electrically grounded.

4. The development device according to claim 1, wherein the conductive contact member has flexibility.

5. The development device according to claim 1, wherein the conductive contact member is substantially in a rectangle shape that has two longitudinal edges along a longitudinal direction and two lateral edges along a lateral direction that is perpendicular to the longitudinal direction, one of the two longitudinal edges is a fixed edge that is fixed to the developer accommodating part, and the other one of the two longitudinal edges is a free edge that is not fixed to the developer accommodating part and is provided on an opposite side of the fixed edge, and multiple incisions are formed from the free edge in the lateral direction.

6. The development device according to claim 5, wherein the film comprises multiple contact regions segmented by the multiple incisions, and in each of the multiple contact regions, the distance from the fixed edge to the free edge becomes shorter toward one end side from the central side in the longitudinal direction of the film.

7. The development device according to claim 1, wherein the conductive contact member is a film that is in a sheet shape, and the film is a plastic film that contains carbon.

8. An image forming unit, comprising:

the development device according to claim 1;

an image carrier to which the developer is supplied from the development device; and a sensor that detects a position of the developer detection member.

9. A development device, comprising:

a developer accommodating part that accommodates a developer, a developer detection member that is rotatably supported inside the developer accommodating part and is for detecting an amount of the developer accommodated inside the developer accommodating part, a rotational drive member that rotates the developer detection member around a rotational axis, and a conductive contact member hat is formed of a conductive material, wherein defining a rotary track through which the developer detection member passes while rotating, a free edge of the contact member is arranged within the rotary track such that the contact member comes in contact with the developer detection member while the developer detection member makes one rotation, the free edge being opposite where the contact member is fixed, the conductive contact member is a film that is in a sheet shape, the film comprises first regions and second regions segmented by multiple incisions, and in a separated state where the developer detection member is separated from the film, a distance between the free edge and the developer detection member in the first regions is shorter than the distance between the free edge and the developer detection member in the second regions.

10. The development device according to claim 9, wherein the conductive contact member is electrically grounded.

11. The development device according to claim 9, wherein the conductive contact member has flexibility.

12. The development device according to claim 9, wherein the film is a plastic film that contains carbon.

13. An image forming unit, comprising:

the development device according to claim 9;

an image carrier to which the developer is supplied from the development device; and a sensor that detects a position of the developer detection member.

14. The development device according to claim 9, wherein the first regions and the second regions are alternately arranged along a longitudinal direction of the film.

15. A development device, comprising:

a developer accommodating part that accommodates a developer, a developer detection member that is rotatably supported inside the developer accommodating part and is for detecting an amount of the developer accommodates inside the developer accommodating part, a rotational drive that rotates the developer detection member around a rotational axis, and a conductive contact member that is formed of a conductive material, wherein defining a rotary track through which the developer detection member passes while rotating, a free edge of the contact member is arranged within the rotary such that the contact member comes in contact with the developer detection member while the developer detection member makes one rotation, the free edge being opposite from where the contact member is fixed, the conductive contact member is a film that is in a sheet shape, the film comprises multiple contact regions segmented by multiple incisions, and in each of the multiple contact regions, the free edge is inclined relative to a virtual line along a longitudinal direction of the film.

16. The development device according to claim 15, wherein the conductive contact member is electrically grounded.

17. The development device according to claim 15, wherein the conductive contact member has flexibility.

18. The development device according to claim 15, wherein the film is a plastic film that contains carbon.

19. An image forming unit, comprising:

the development device according to claim 15;

an image carrier to which the developer is supplied from the development device; and a sensor that detects a position of the developer detection member.

20. The development device according to claim 11, wherein the film comprises multiple contact regions segmented by the multiple incisions, and in each of the multiple contact regions, the distance from the fixed edge to the free edge becomes shorter toward one end side from the central side in the longitudinal direction of the film.

* * * * *